US005810635A

United States Patent [19]

Heider et al.

[11] Patent Number: 5,810,635

[45] Date of Patent: Sep. 22, 1998

[54] HIGH-PRESSURE DISCHARGE LAMP, METHOD OF ITS MANUFACTURE, AND SEALING MATERIAL USED WITH THE METHOD AND THE RESULTING LAMP

[75] Inventors: Juergen Heider, Munich; Stefan Juengst, Zorneding, both of Germany; Koichiro Maekawa, Ichinomiya; Osamu Asano, Hashima, both of Japan

[73] Assignees: Patent-Treuhand-Gesellschaft Fuer Elektrische Gluehlampen mbH, Munich, Germany; NGK Insulators, Ltd., Nagoya, Japan

[21] Appl. No.: 705,114

[22] Filed: Aug. 29, 1996

Related U.S. Application Data

[62] Division of Ser. No. 553,827, Nov. 6, 1995, Pat. No. 5,592,049, which is a continuation of Ser. No. 146,969, Nov. 3, 1993, abandoned.

[30] Foreign Application Priority Data

Feb. 5, 1993 [EP] European Pat. Off. ..... 93 101 831.1

[51] Int. Cl.[6] ..... H01J 9/26; H01J 9/32

[52] U.S. Cl. ..... 445/26; 445/43; 445/40

[58] Field of Search ..... 228/124.7, 122.1; 445/26, 43

[56] References Cited

U.S. PATENT DOCUMENTS

| | | | |
|---|---|---|---|
| 2,477,715 | 7/1949 | Claassens et al. . | |
| 3,531,853 | 10/1970 | Klomp | 228/124.7 |
| 3,832,589 | 8/1974 | Pfaye . | |
| 3,832,590 | 8/1974 | Yamazaki et al. . | |
| 3,905,845 | 9/1975 | Kobayashi et al. . | |
| 4,122,042 | 10/1978 | Meden-Piesslinger et al. . | |
| 4,366,410 | 12/1982 | Buhrer . | |
| 4,475,061 | 10/1984 | van de Weijer et al. . | |
| 4,501,799 | 2/1985 | Driessen et al. . | |
| 4,530,909 | 7/1985 | Makishima et al. . | |
| 4,545,799 | 10/1985 | Rhodes et al. . | |
| 4,568,652 | 2/1986 | Petty, Jr. . | |
| 4,687,969 | 8/1987 | Kajihara et al. . | |
| 4,789,501 | 12/1988 | Day et al. . | |
| 4,808,881 | 2/1989 | Kariya et al. . | |
| 4,959,588 | 9/1990 | Vida et al. . | |
| 5,075,587 | 12/1991 | Pabst et al. . | |
| 5,352,952 | 10/1994 | Juengst | 313/623 |
| 5,404,078 | 4/1995 | Bunk et al. | 313/625 |
| 5,484,315 | 1/1996 | Juengst et al. | 445/26 |

FOREIGN PATENT DOCUMENTS

| | | |
|---|---|---|
| 0 011 993 | 6/1980 | European Pat. Off. . |
| 0 472 100 A3 | 2/1992 | European Pat. Off. . |
| 2 307 191 | 8/1973 | Germany . |

OTHER PUBLICATIONS

Ceramics Monthly, "Locating Glaze Material", by M. Petersham, pp. 22–24, Jun./Jul./Aug. 1995.

Clay and Glazes, by Daniel Rhodes, Chilton Book Company, Radnor, Pennsylvania.

*Primary Examiner*—Kenneth J. Ramsey

*Attorney, Agent, or Firm*—Frishauf, Holtz, Goodman, Langer & Chick, P.C.

[57] ABSTRACT

A ceramic discharge vessel (8) for a high-pressure discharge lamp has a pin-like feedthrough (10) inserted in a plug (11) made from a composite material. The feedthrough (10) has been sintered directly into the plug (11) and is additionally sealed by covering the area, surrounding the feedthrough, of the plug's surface facing away from the discharge volume with a ceramic sealing material **(7*a*)**.

12 Claims, 7 Drawing Sheets

HIGH-PRESSURE DISCHARGE LAMP, METHOD OF ITS MANUFACTURE, AND SEALING MATERIAL USED WITH THE METHOD AND THE RESULTING LAMP

This is a Division of application Ser. No. 08/553,827, filed Nov. 6, 1995, now U.S. Pat. No. 5,592,049, which is a continuation of Ser. No. 08/146,969, filed Nov. 3, 1993 abandoned.

Reference to related patents and applications, the disclosures of which are hereby incorporated by reference:

U.S. Pat. No. 4,501,799, Driessen et al

U.S. Pat. No. 4,808,881, Kariya et al

U.S. Pat. No. 4,366,410, Buhrer

U.S. Pat. No. 5,075,587, Pabst et al

U.S. Pat. No. 4,475,601, Van de Weiger et al

U.S. Pat. No. 3,832,590, Yamazaki et al

U.S. Pat. No. 4,277,715, Claassens et al

U.S. Pat. No. 4,122,042, Meden-Piesslinger et al

U.S. Pat. No. 4,545,799, Rhodes et al

U.S. Ser. No. 07/912,526, filed Jul. 12, 1992, now Pat. No. 5,404,078, Bunk et al, to which European 92 114 227.9 corresponds;

U.S. Ser. No. 07/954,815, filed Oct. 1, 1992, now Pat. No. 5,352,952, Juengst;

U.S. Ser. No. 08/211,608, filed Apr. 7, 1994, now Pat. No. 5,484,315, Juengst et al; also published as WO 93/07638, Reference to related disclosures:

German DE-OS 23 07 181, Nienhuis et al, to which Canadian Patent 964,323 corresponds;

European 0 011 993 Al, Brown et al, to which British 2,036,420 corresponds;

European A-0 472 100, to which U.S. Ser. No. 07/742, 049, abandoned, corresponds.

FIELD OF THE INVENTION

The present invention relates to a high-pressure discharge lamp, to a method of its manufacture, as well as to a sealing material, in which the high-pressure discharge lamp has tubular ends which are closed by a ceramic plug member, in which a metallic current feedthrough is gas-tightly sealed.

BACKGROUND

Such high-pressure discharge lamps may be high-pressure sodium discharge lamps, and, more specifically, metal halide lamps having improved color rendition. The use of a ceramic discharge vessel for the lamps enables the use of the higher temperatures required for such vessels. The lamps have typical power ratings of between 50 W–25 W. The tubular ends of the discharge vessel are closed by cylindrical ceramic end plugs comprising a metallic current feedthrough passing through the axial hole therein.

Customarily, these current feedthrouhs are made of niobium tubes or pins (U.S. Pat. No. 5,352,952 and EP-A 472 100). However, they are only partly suitable for lamps that are intended for a long useful life. This is due to the strong corrosion of the niobium material and, possibly, the ceramic material used for sealing the feedthrough into the plug when the lamp has a metal halide fill. An improvement is described in the European Patent Specification EP-PS 136 505 to which U.S. Pat. No. 4,545,799, Rhodes et al. corresponds. A niobium tube is tightly sealed into the plug by the shrinking process of the "green" ceramic during the final sintering without ceramic sealing material. This is readily possible because both materials have approximately the same thermal expansion coefficient ($8\times10^{-6}$ $K^{-1}$).

Although metals such as niobium and tantalum have thermal expansion coefficients that match those of the ceramic, they are known for having poor corrosion resistance against aggressive fills and they have not yet been available for use as a current feedthrough for metal halide lamps.

Metals having a low thermal expansion coefficient (molybdenum, tungsten and rhenium) are the metals which have a high corrosion resistance against aggressive fills. Their use as a current feedthrough is, therefore, highly desirable. However, the problem of providing a gas-tight seal while using such feedthroughs has remained unsolved in the past.

It has already been attempted to use a molybdenum tube as a feedthrough (EP-PA 92 114 227.9; Art. 54(3) EPC to which U.S. Pat. No. 5,404,078, Bunk et al. corresponds). In order to avoid the use of ceramic sealing material which can be corroded by aggressive fill materials, the tube is gas-tightly sintered directly into the plug without any sealing material. This has to be done by a special manufacturing method. The best results are obtained by using a two-part feedthrough and/or a plug composed of two or more materials. Reference to the contents of that disclosure is expressly made, especially to-the manufacturing method and to the composition of the plug material. In the said application the use of solid molybdenum pins is said to be disadvantageous because a pin cannot deform.

The use of a solid molybdenum pin as a feedthrough in connection with a ceramic vessel and plug, made from alumina, has also been discussed in the past. However, the gas-tightness between the plug and the pin is obtained by using a rather corrosion resistant sealing material (glass melt or ceramic melt) which is filled into the gap between the hole of the plug and the feedthrough (see for example U.S. Pat. No. 2,477,715 Claassens et al. Pin diameters of approximately, or not more than 600 $\mu$m are used.

A detailed discussion of this technique is given in the U.S. Pat. No. 4,475,601, Van de Weiger et al. A molybdenum pin with a diameter of 0.7 mm is inserted into a plug having a hole of 0.8 mm diameter. Therefore, the gap between the pin and the plug wall is 0.05 mm. This gap, although in this application declared as being small, is quite big and facilitates the flowing of the sealing material—in this case, alkaline earth oxides—into the gap.

From DE-A 23 07 191, to which and U.S. Pat. No. 4,122,042 corresponds, a metal halide lamp is known which has a ceramic vessel with a plug made from a cermet consisting of alumina and molybdenum metal. A feedthrough of molybdenum is directly sintered into the plug. Obviously, this plug is electrically conductive because it is shielded from the discharge volume by a layer of insulating material which covers the surface of the plug facing the discharge volume.

This arrangement is disadvantageous because the metal halide fill can react with this material which also serves as a sealing material for the interface between the plug and the vessel end. As a consequence, a reliable long-time gas-tightness cannot be obtained and the maintenance of such a lamp is unsatisfactory.

Such lamps never came into use. The reason for this presumably is that these arrangements were unable to provide for protection against the inevitable corrosion of the sealing material.

THE INVENTION

It is an object of the invention to provide a feedthrough technique and a sealing material which is capable of resisting corrosion and changes of temperature and which can be used, more particularly, for ceramic vessels having a metal halide containing fill. Various methods will be described, showing how these lamps with the feedthroughs are made.

The vessels have a reliable long-time gas-tightness and an excellent maintenance because the contact between the sealing material and the aggressive fill is reduced to an extremely low level.

Briefly, the present invention takes advantage of a solid pin made from a corrosion resistant material whose thermal expansion coefficient is lower than that of the plug. Pins made from molybdenum, tungsten and rhenium are much cheaper than tubes made from these metals.

It is a feature of the invention that, for solid pins, a reliable long-time gas-tightness can be established by combining the two techniques of direct sintering and of sealing with a ceramic sealing material, together with an appropriate choice of the plug material.

A first important parameter of the present invention is the diameter of the pin. In contrast to the diameter of tubes, which is about 2 mm, a diameter of at most 550 $\mu$m is recommended. This is because the smaller the diameter, the less the forces which occur during thermal expansion. Preferred diameters are below 350 $\mu$m and above 150 $\mu$m. These reflections are necessary because of the non-adapted thermal expansion coefficients of plug and feedthrough.

The second important parameter is the material of the ceramic plug. A tight bond can only be obtained by graded steps of thermal expansion between the vessel and the feedthrough. Therefore, the plug should consist of a composite body.

Its main component is alumina (at least 60%) and the second component comprises one or more materials having a thermal expansion coefficient which is lower than that of the alumina. Therefore, this plug has a thermal expansion coefficient markedly below that of alumina.

The structure of the composite body used as a plug may be that of a cermet known in the prior art. Cermet is electrically conductive. In this case it is made by rolling together a finely divided powder of the metal, typically tungsten or molybdenum having a mean particle size of 1 $\mu$m, and much coarser granules or agglomerates of alumina whose particle size is between 50 and 200 $\mu$m—the granules or agglomerates of alumina having been obtained by granulating alumina fine powder with an average particle size of 0.3 $\mu$m—until the latter are uniformly coated with the metal powder, whereafter the coated granules are compacted to form a coherent body and are subsequently sintered, and result in an ellipsoidal network structure, thus making the body electrically conductive.

In contrast with the above, the composite body, in a preferred embodiment of the present invention is not electrically conductive. The composite body is made from a homogeneously mixed dispersion of fine alumina powder having, in a preferred embodiment, an average particle size of 0.3 $\mu$m, and of second-component materials having about the same particle size as the alumina powder. This dispersion is compacted to form a plug-shaped body and is subsequently sintered. Thus, the obtained body does not have any network structure making it electrically conductive.

The advantage of such non-conductivity is that the undesired back-arcing within the discharge volume is avoided. An insulating layer at the surface of the plug facing the discharge volume is thus no longer required, although it may be desirable when it is made from alumina. Furthermore, the structure of the plug is more dense, and, therefore, its inherent gas-tightness is superior to that of a cermet.

Preferred second-component materials are molybdenum, rhenium, or tungsten. An extremely favourable feature of these second components is that Mo or W metal components dispersed in the composite plug body deposit to the surface of the feedthrough to form many contacting spots, wherein these spots are formed as one grain comprising the grain structure of the composite body and result in permitting an improved bonding between plug and feedthrough. Instead of using the metals Mo or W as a starting material for making the composite body, it is possible to use their oxides such as, for instance, $MoO_3$ or $WO_3$. The reason is that such metal oxides can be mixed extremely homogeneously with the alumina and can be easily decomposed or reduced to form exclusively or mainly the pure metal due to an atmospheric sintering. Other second-component materials are graphite, AlN, TiC, SiC, ZrC, $TiB_2$, $Si_3N_4$ and $ZrB_2$.

A third important parameter is the relationship between the diameter of the plug hole and of the feedthrough. Direct sintering of these parts without cracks being formed during the sintering is feasible only if the shrinking of the plug itself during the final sintering is such that it corresponds to a slight pressing force that would have to be used in order to obtain a hypothetical final diameter of the plug hole which would be smaller—a recommended value is 0% to 2% less and, preferably, 0.5% to 1.5% less—than the diameter of the feedthrough. However, a pure direct sintering of pin-like feedthroughs cannot guarantee gas-tightness, except under very special circumstances (through precise matching of the composition of the plug material) and under the premises that the diameter of the feedthrough does not exceed 350 $\mu$m. Feedthroughs which are as thin as this may only be used in extremely low-power lamps with a power rating of 35 W—150 W or so.

In order to obtain a reliable long-time gas-tightness under all imaginable conditions, e.g., variation of the composition of the plug material, or, thicker feedthroughs-, and without a limitation of the power rating, a very surprising step turned out to be successful. Although there is no gap between the feedthrough and the plug where a sealing material could be filled in, it proved successful to cover the surface of the plug facing away from the discharge with a ceramic sealing material. Keeping in mind that there does not yet exist any absolutely corrosion resistant sealing material, the positive behaviour of the inventive arrangement may be interpreted in the following way: during the first part of its lifetime, the bond is due to the direct sintering. After several temperature cycles, the non-adapted behaviour of the plug and feedthrough causes small fissures or splits along which the fill can creep to the outside of the vessel. The fill thus reaches the sealing material at the surface of the plug facing away from the discharge with a time lag, and it is only then that corrosion of the sealing material starts.

The U.S. Pat. No. 4,122,042 describes several sealing materials which allegedly can be used for ceramic discharge vessels with a feedthrough made from molybdenum and a metal halide fill. They are based on the components $SiO_2$, $La_2O_3$, $Al_2O_3$, $B_2O_3$ and $Y_2O_3$. It turned out, however, that they are unsuitable for two reasons. Firstly, they obviously have a non-adapted thermal expansion coefficient so that the problem of small fissures and splits occurs again. Secondly, some of the oxide components of the sealing material (for example, lanthania, also denominated as lanthanum oxide) tend to react with the halide components of the fill, especially with the rare earth halides.

More precisely, the lanthanum of the sealing material and the rare earth metal of the fill exchange their binding partners (oxygen and halogen, respectively), with the result that rare earth oxides and lanthanum halide are formed. This weakens the multi-line light spectrum of the rare earths and causes the color rendering index and operating voltage to decrease.

One aspect of the present invention is that the following sealing material has overcome the above mentioned difficulties: $SiO_2$, $Al_2O_3$, $Y_2O_3$ and at least one of $La_2O_3$ or $MoO_3$ or $WO_3$. Under special circumstances, addition of W, or Re, or of pure molybdenum powder is advantageous.

This composition has a thermal expansion coefficient which better matches the thermal expansion coefficients of the plug and of the pin. The amounts of components which are critical with respect to the fill can be minimized, and the bonding behaviour is improved. It is especially advantageous for use in connection with a composite plug.

A first embodiment of a sealing material composed of $Al_2O_3$, $SiO_2$, $Y_2O_3$ and $La_2O_3$ can be used preferably for the interface between a very thin molybdenum feedthrough (wires having a diameter below 350 $\mu$m) and a plug when direct contact of sealing material and fill is avoided. It can therefore be applied to the surface of the plug facing away from the discharge volume.

In a preferred second embodiment, the sealing material has besides $Al_2O_3$, $SiO_2$, $Y_2O_3$ and $La_2O_3$ an additional amount of molybdenum metal powder. Its proportion is up to 20% by weight. The lanthania can partly or completely be substituted by $MoO_3$. Preferably, this second embodiment is used for the interface between a molybdenum feedthrough (either pin-like or tubular) and a plug, preferably without direct contact to the fill (cf. first embodiment). Here, the diameter of the feedthrough does not play any role because the thermal expansion coefficient is very suitable. A preferred range of proportions is (by weight) 15–30% $Al_2O_3$, 25–35% $Y_2O_3$, 10–30% $La_2O_3$ and 1–20% Mo metal. This sealing material is quite good in its flowability, and its working temperature for sealing is lower than 1450° C. The positive aspects of the second embodiment have to do with the fact that when the sealing material starts to melt by heating, the added molybdenum metal may concentrate and/or deposit around the feedthrough (pin or tube) and act as a sort of cushion absorbing the bouncing force of the feedthrough. Thus, splits and fissures are prevented.

In accordance with a third preferred embodiment the lanthania component is fully substituted by $MoO_3$ or even $WO_3$. Such a sealing material can have contact to the fill without the undesired reactions discussed above. The thermal expansion coefficient of this sealing material can match that of the plug material. Therefore, this sealing material is especially suitable for bonding the plug to the vessel end. It may also be applied to the interface between the plug and the molybdenum feedthrough. A preferred range of proportion is (by weight) 20–35% $Al_2O_3$, 20–30 $SiO_2$, 30–40% $Y_2O_3$ and 1–10% $MoO_3$. The latter can partly or fully be substituted by $WO_3$. Inside this preferred range, the flowability, the melting point and the wettability of the sealing material are at an optimum. Deviation from this optimum range may result in premature lack of gas-tightness at the interfaces of sealed portions due to cracks in the sealing layer.

Although the third embodiment is a little less advantageous with respect to flowability than the second embodiment, it is superior with respect to resistance against attack by aggressive fill material, since its sealing temperature is about 100 degrees higher than that of the second embodiment.

The novel sealing material (especially the second and third embodiments) is not only suitable for the special arrangements discussed hitherto but also for other types of pin-like or tubular feedthrough arrangements or even other types of feedthroughs, for example using other materials (e.g., tungsten or rhenium) and also for any type of connection between a plug and a vessel end. It is especially preferred in connection with a plug made from a composite body which is not electrically conductive as mentioned above. The reason for this surprising effect is not completely clear. It may have to do with an ability of the sealing material's molybdenum component (especially its oxide) to improve the wettability of the feedthrough and the plug by the sealing material. This may result in the formation of a superior gas-tight bonding layer at the interfaces between the plug and the vessel end (if not directly sintered) or between the plug and the feedthrough.

Preferably, the surface roughness of the feedthrough is about 0.5–50 $\mu$m by Ra. The feedthrough can be made from tungsten, molybdenum, rhenium, or an alloy of tungsten, or of molybdenum, or of rhenium.

Preferably, the gas-tightness at the end of the discharge vessel can be further enhanced by a suitable arrangement of the plug including the feedthrough within the vessel end.

Advantageously, the end of the vessel is elongated like a tube, and the plug is located at the outermost end thereof, that is, as remote from the discharge as possible. The temperature at the tube end is about 100 degrees lower than in a conventional arrangement where the plug is located closer to the discharge.

Therefore, the corrosion resistance of the sealing material is better because it depends exponentially on the temperature. Besides, the maintenance of such a lamp is improved because the loss of fill material is delayed since it hardly reacts with the sealing material.

The manufacture of such ceramic discharge vessels can be carried out in different ways. A general feature of all concepts is that only a first end is completely closed by a plug having a pin-like feedthrough. This end is the blind end; the second end acts as the pump end which has to be closed later in a soluble manner. In a first concept, the second end is also provided with a plug and feedthrough assembly, simultaneously with the first end, however, the second vessel end has a small opening therein, to be closed subsequent to evacuating and filling. Preferably, the pump end is provided with a tubular feedthrough and can be filled as pointed out in the PCT/DE92/00372, U.S. Ser. No. 08/211,608, filed Apr. 7, 1994 issued as U.S. Pat. No. 5,484,315, which is incorporated by reference, for example through a small-hole in the tubular feedthrough. Another possibility is that the feedthrough is pin-like, too, and a small bore is left in the wall of the vessel end.

For this concept, in a first step the pin, with an electrode system connected thereto, is inserted into the central hole in a first plug which is still in its green state. At the same time a tubular or pin-like feedthrough is inserted into the central hole of a second plug which is in its green state. Then both plug-feedthrough assemblies are positioned in the first and second ends of the ceramic vessel which, itself, is still in the green state, too.

The complete assembly—discharge vessel with two plugs—is then finally sintered. The bond between the plug and the feedthrough, i.e. the interface of the outside of the feedthrough and the inside of the opening in the plug, is devoid of any sealing material. Subsequently, a sealing material is applied to the feedthrough-plug interface at the surface of the first or, preferably, both plugs facing away from the discharge. The discharge vessel is evacuated and filled through the opening at the second end, which is then closed. For example, this can be done either by filling up a small hole in the tubular feedthrough (with an electrode system already being attached to the tube) or by inserting an electrode system into the tubular feedthrough. The gas-tightness at the second end in this case may be obtained by welding. In the case of a bore in the wall of the vessel end, it can be closed by inserting sealing material or a special plug.

In this first concept not only the feedthroughs are directly sintered into the plugs but also both plugs are directly sintered into the vessel ends. The contact of any sealing material to the discharge volume is therefore minimized (in case of a filling bore in the wall) or completely avoided (in case of a tubular feedthrough), which is a breakthrough in the technology of this lamp type.

With respect to the pressing force corresponding to the shrinking to a hypothetical final diameter (see above) of the vessel end and plug, the following is of importance in connection with pin-like feedthroughs: in case of co-firing a Mo pin/plug assembly only, a shrinking rate of 0–2% is favourable for the plug. In case of co-firing a Mo pin/plug/vessel end assembly, in order to maintain the gas-tightness between the plug and the vessel end, the shrinking rate of the vessel end against the plug needs to be at most up to 10% and, preferably, 3–5%. Therefore, the shrinking rate loading on the Mo pin is the combined value from the plug and the vessel end; its optimum value is 3–7%. A shrinking rate of $\leqq 10\%$ for an assembly plug/Mo pin (of 0.3 mm diameter) and $\leqq 6\%$ for an assembly plug/Mo pin (of 0.5 mm diameter) are the maximum values to make a Mo pin/plug/vessel end co-fired body. It is true that, if the Mo pin/plug assembly only is co-fired by applying a shrinking rate of more than 2%, it often causes plugs cracking but a Mo pin/plug/vessel end co-fired body does not cause any cracking in limiting its shrinking rate to the above values. It is assumed that the plug body absorbs a part of the loading force caused by the shrinking of the vessel end to make the force on the Mo pin itself considerably lower.

In a second concept, only pins are used as the feedthroughs for both ends of the discharge vessel. Therefore, both pins are inserted in their plugs while the plugs still are in the green state. The first feedthrough-plug assembly is inserted into the first end of the discharge vessel which itself is in the green state. However, the second end of the discharge vessel remains open. Then both the subassembly represented by the vessel with the first plug inserted therein and the second plug-feedthrough assembly are separately finally sintered.

A sealing material is applied to the surface of the first plug facing away from the discharge. The vessel is filled with the ionizable material, and it is only then that the second assembly is inserted into the second end of the discharge vessel, and a sealing material is applied, simultaneously or in a later step, to the feedthrough-plug interface and the gap between the second plug and the second end of the discharge vessel.

It is preferred to provide the second plug with a circumferential groove to stop the sealing material from flowing to the region near the discharge volume. Again, the reaction of the fill material with the sealing material is reduced and maintenance is improved.

Any time that a sealing material has to be applied, a heating step is necessary, as any person skilled in the art knows.

The present invention provides a ceramic vessel for a high-pressure discharge lamp of long life whose tightness is not impaired by the use of halide containing fills. The discharge vessel is customarily tubular, either cylindrical or barrel-shaped. There is a direct bond between the plug, which may be formed cylindrical or as a top-hat, and the discharge vessel. This bonding is carried out as known in the prior art. Frequently, the discharge vessel is arranged in an outer bulb which may be single-ended or double-ended.

DRAWINGS

The invention will now be more closely described by way of several practical examples.

FIG. 1 shows a metal halide lamp having a ceramic discharge vessel;

FIGS. 2*a–c* show two other embodiments of such a lamp;

DETAILED DESCRIPTION

Figure 1:
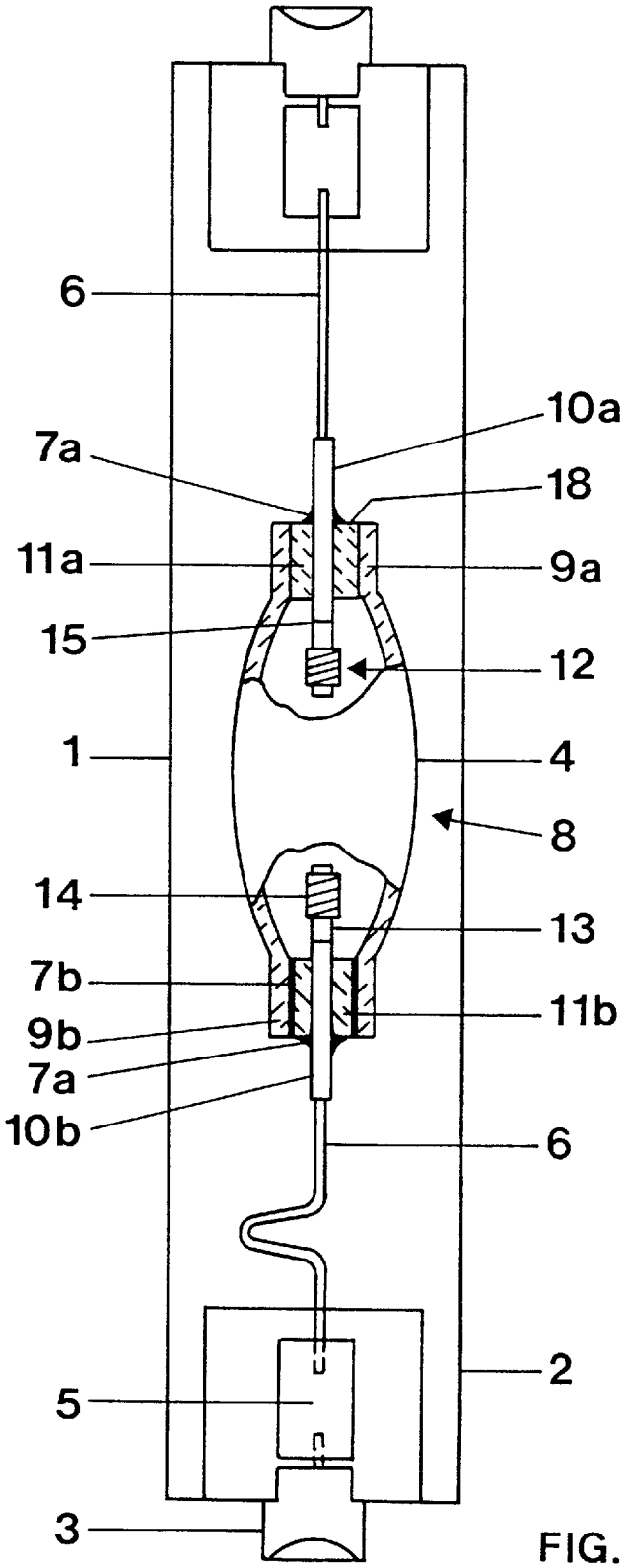

FIG. 1 shows, schematically, a metal halide discharge lamp having a power rating of 150 W. It includes a cylindrical outer envelope 1 of quartz glass or hard glass defining a lamp axis. The outer envelope is pinch-sealed 2 on both sides with bases 3. The axially aligned discharge vessel 8 of alumina ceramic has a barrel-shaped middle portion 4 and cylindrical ends 9. It is supported in the outer envelope 1 by means of two current supply leads 6 which are connected via foils 5 to the bases 3. The current supply leads 6 are welded to pin-like current feedthroughs 10 which are directly sintered into a central axial hole in the respective ceramic plugs 11 of composite material at the end of the discharge vessel.

The two solid current feedthroughs 10 of molybdenum (or of tungsten or of a tungsten/rhenium alloy, if desired) each support an electrode system 12 on the side facing the discharge. The electrode system consists of an electrode shaft 13 and a coil 14 slipped onto the end of the electrode shaft on the side facing the discharge. The shaft of the electrode is gas-tightly connected by a butt-weld to the end of the current feedthrough at the seam 15. In this embodiment both the feedthrough and the shaft have the same diameter of 500 $\mu$m.

The fill of the discharge vessel comprises, in addition to an inert starting gas such as, for example, argon, mercury and additives of metal halides. In another example the mercury component can be omitted.

Both plugs 11 are made from a ceramic, electrically non-conductive material consisting of 70% by weight of alumina and 30% molybdenum. The thermal expansion coefficient of this material is about $6.5\times10^{-6}$ $K^{-1}$ and lies between the thermal expansion coefficents of pure alumina ($8.5\times10^{-6}$ $K^{-1}$) of the vessel 8 and of the molybdenum pin 10 ($5\times10^{-6}$ $K^{-1}$).

At the first end 9*a* of the vessel, which is the blind end, the first plug 11*a* is directly sintered into the end 9*a*. The gas-tightness is additionally accomplished by a sealing layer 7*a* covering the outer surface 18 of the first plug 11*a* in the vicinity of the feedthrough 10*a*.

In a preferred first embodiment the sealing material 7*a* may consist of 32% $Y_2O_3$, 23% $Al_2O_3$, 26% to $SiO_2$, 14% $La_2O_3$ and 7% Mo metal. In a second preferred embodiment it may consist of 5% $MoO_3$, 38% $Y_2O_3$, 30% $Al_2O_3$ and 27% $SiO_2$.

The first embodiment very well matches the feedthrough-plug system with respect to thermal expansion. This feature is especially important for larger diameters (about 400–500 μm) of the pin since cracks and fissures may occur along the plug-feedthrough interface into which the sealing material can flow.

At the second end 9*b* of the vessel, which is the pump end, the second plug 11*b* has been inserted after the evacuating and filling through the still open end. A gas-tight bond between the outer circumference of the plug 11*b* and the vessel end 9*b* is obtained by a sealing material 7*b,* located in the gap therebetween. The sealing material is preferably composed of the second preferred embodiment which includes $MoO_3$. This sealing material very well matches the thermal expansion behaviour of vessel end 9*b* and plug 11*b* which is different from the plug-feedthrough system.

Similar to the first plug, a sealing layer 7*a* covers the interface between the feedthrough 10*b* and the plug 11*b* at the surface 18 facing away from the discharge volume. This sealing layer 7*a* is made in accordance with either the first or the second preferred embodiment.

During manufacture of the lamp, the application of the sealing material can be carried out step by step. Alternatively, two of the three sealing steps (either the covering of the interfaces between the feedthrough and the plug at both ends (first case) or the two sealing steps at the second end (second case)) can be carried out simultaneously when the second plug has been inserted. Preferably, only one type of sealing material is used for the simultaneously carried out steps in these two cases, preferably that of the first preferred embodiment in the first case and that of the second preferred embodiment in the second case. Although this second sealing material without a lanthania component has a comparatively high working temperature and is a little less advantageous in its flowability. it does not have any bad influence on the color rendering index and the color temperature of the lamp, in spite of the fact that the sealed layer is in contact with the aggressive fill.

Figure 2A:
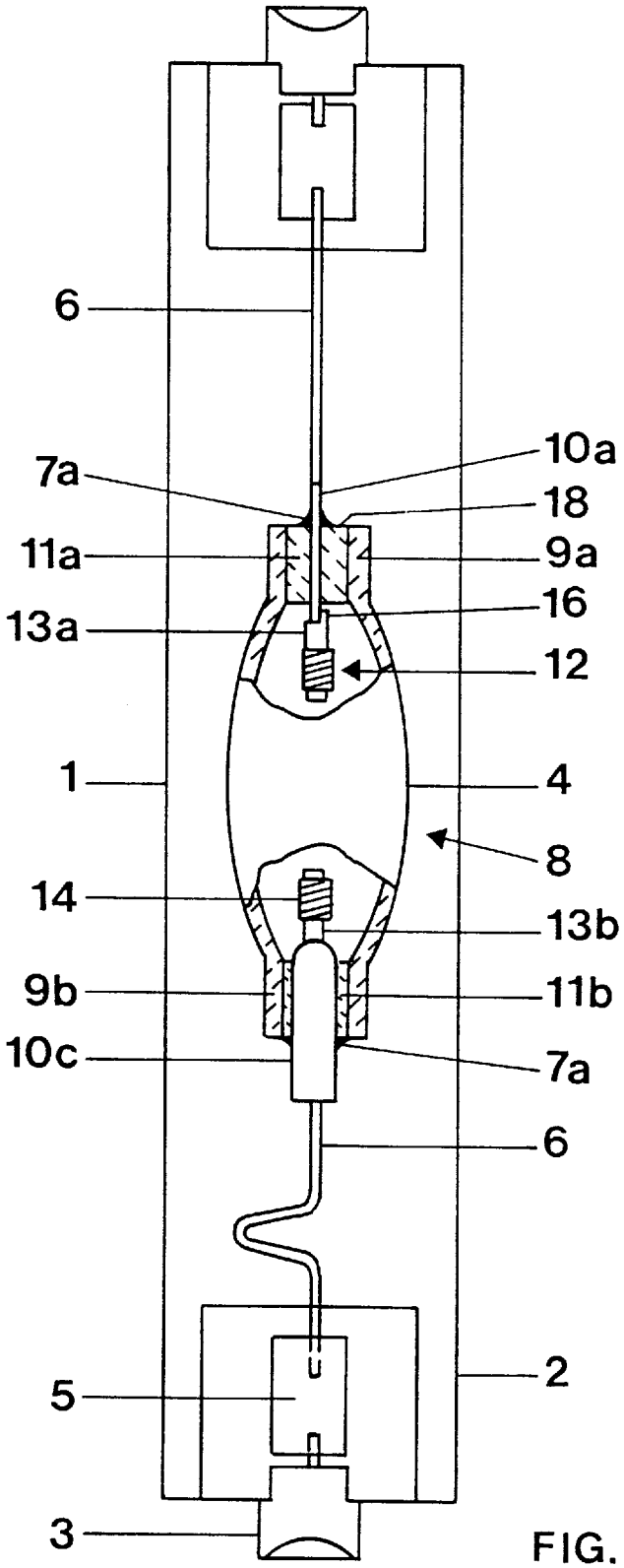
Figure 7:
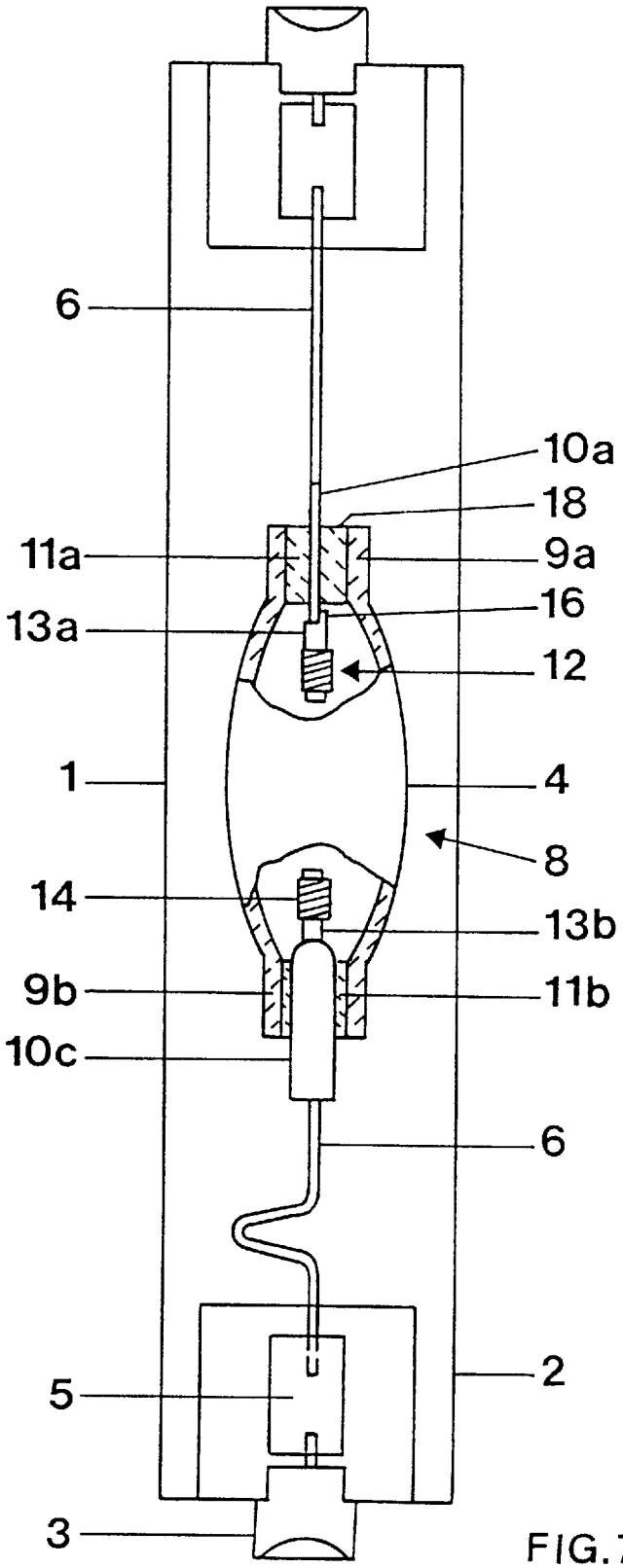
FIG. 7 shows another embodiment of the lamp.

In a further or second, preferred embodiment of a lamp, having a power rating of 50 W, shown in FIG. 2*a,* the same parts are designated with the same reference numbers as in FIG. 1. The differences are as follows. The first plug 11*a* has a pin-like feedthrough 10*a* having a diameter of only 300 μm. The absolute thermal expansion of this feedthrough is so strongly reduced that the sealing layer 7*a* at the outer surface 18 is no longer necessary, although it is recommended. FIG. 7 shows both outer surfaces 18 without sealing layer 7*a*. The first plug 11*a* is directly sintered in the first end 9*a* of the vessel. The electrode shaft 13*a* is made from tungsten and has a diameter of 0.5 mm. In this case the end portion of the shaft is partly ground along the axial direction thereof and a projection 16 is formed. This axially aligned projection 16 is connected by spot-welding to the end of the feedthrough which extends parallel to the projection 16.

The second plug 11*b* likewise is directly sintered in the second end 9*b* of the vessel 8. This can be done because the second feedthrough consists of a molybdenum tube 10*c* which has itself been directly sintered in the second plug 11*b*. Again it is preferred, though not necessary, to improve the bond of the plug-feedthrough interface by using a sealing material 7*a* covering the area around the feedthrough at the surface 18 of the plug facing away from the discharge volume. Preferably, from view points of its working temperature and superior flowability, the sealing material of the first preferred embodiment should be used for this seal. Evacuating and filling is performed through a small bore in the vicinity of the electrode shaft which is closed after filling.

The sealing materials at the interfaces of both ends can be applied simultaneously, preferably before closing of the filling bore.

Figure 2B:
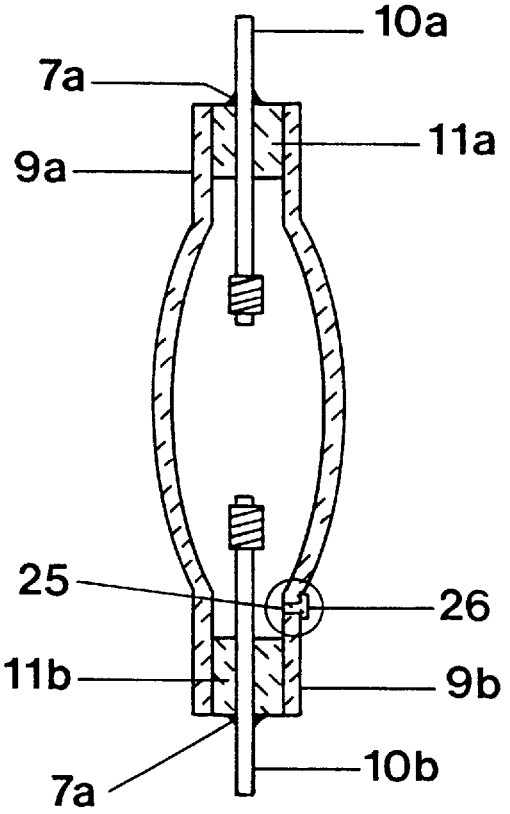
Figure 2C:
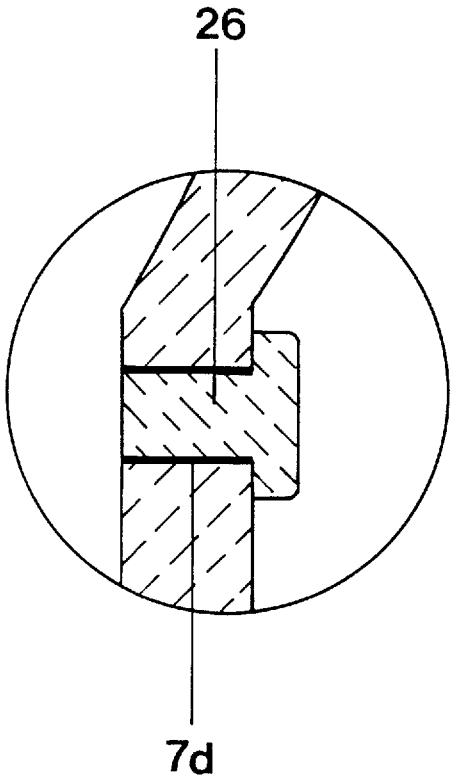

In a third embodiment (FIG. 2*b*) a pin-like feedthrough 10 of 300 μm diameter is used at both ends 9 of the discharge vessel 8. And both plugs 11 are sintered directly into the ends 9. A filling bore 25 with a diameter of 1 mm (or more) is arranged separately in the wall of the vessel (or of the plug) near the second end 9*b* thereof. Preferably, it is 1 mm or more away from the top surface of the second plug facing the discharge volume. The reason is that the aggressive metal halide fill components always tend to condense around the surface of the plug. If there is any sealing material which is in contact with the discharge volume around this surface, it could be attacked by these aggressive fill components. Therefore, it is preferable that the sealed portion is distant from the deposit place of fluid halide. Evacuating and filling is performed through the small filling bore 25 in the wall of the second vessel end 9 which is closed after filling. This closing is done by inserting a small plug or stopper 26 (enlarged detail of FIG. 2*c*) made from a ceramic, which comprises substantially alumina, and bonding gas-tightly a gap between the bore 25 and the inserted stopper 26 with a sealing material 7*d,* preferably made of the sealing material 7*a* of the second preferred embodiment of sealing materials containing $MoO_3$. Though not necessary, it is preferred to improve the bond of the plug-feedthrough interface by sealing the area around the feedthrough at the surface of the plug facing away from the discharge volume. Both sealing materials 7*a* can be applied simultaneously, after filling.

Figure 3:
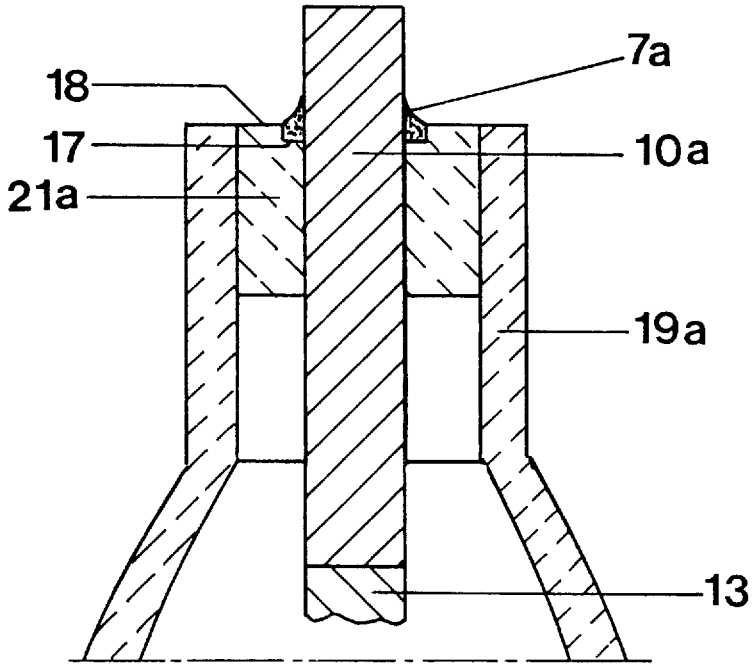

FIG. 3 shows, highly schematically, a further preferred embodiment. Only the region of the vessel end 19*a* is shown in detail. The ends (especially the first end 19*a*) of the discharge vessel are elongated and form a hollow, tubular stub. The plug 21*a* is arranged in the end of the tubular stub remote from the discharge leaving a ring-shaped channel 29. By this arrangement, the temperature of the sealing material 7*a* is about 100 degrees lower than without such a stub-shaped end of the vessel. Therefore, corrosion of the sealing material 7*a* at the plug-feedthrough interface will be retarded. In this embodiment, the feedthrough 10*a* has an appropriate length in the discharge volume. At both ends 19*a, b* (see also FIG. 4), the surface 18 of the plug 21*a,* 21*b,* facing away from the discharge volume, is provided with an annular recess 17 around the feedthrough 10*a,* 10*b,* into which the sealing material 7*a* can be filled. In this way, gas-tightness can be improved.

Figure 4:
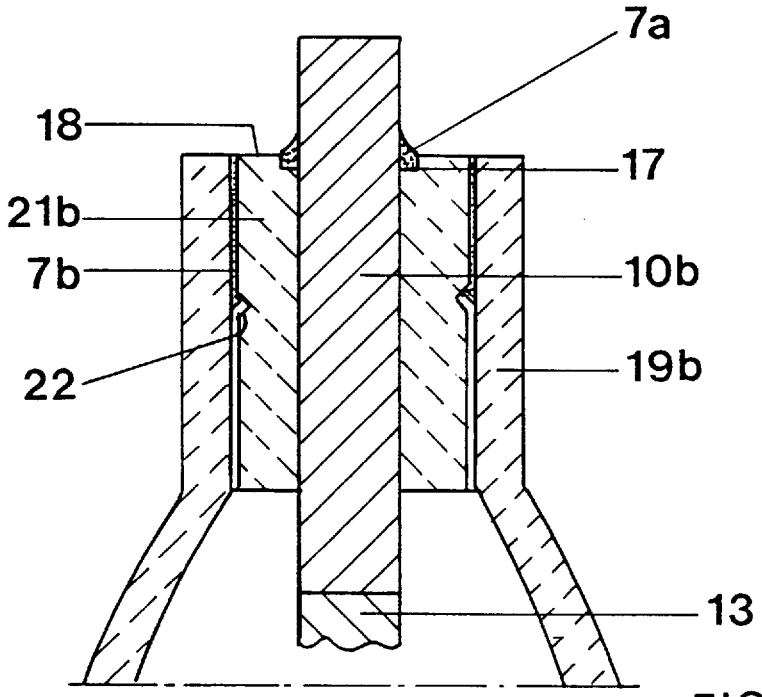
FIGS. 3–6 show in detail several practical examples of the end region of the discharge vessel in section.

In order to avoid any reaction between the aggressive halide fill and the sealing material used for the second end in the first embodiment and in order to reliably close the gap between the outer circumference of the plug 21*b* and the vessel end 19*b,* it is preferred—as shown in FIG. 4—that the second plug 21*b* is provided with a circumferential groove 22 at about the middle of its height. The fluid sealing material 7*b,* when heated and flowing inwardly from the outer surface 18, is stopped in the groove 22, far away from the discharge volume. It is preferred that the second plug 21*b* fills the entire channel of the elongated end 19*b* to better separate the sealing material 7*b* from the discharge volume. As can be clearly seen from FIGS. 3, 4, 5*a,* 5*b,* and 6, there is no sealing material between the feedthrough and the plug.

A preferred embodiment for thin feedthroughs having a diameter of about 200–300 μm provides for better stabilisation. Since such a thin feedthrough lacks stability, the electrode shaft, which has a diameter of 500 μm. may be loosely enclosed in a cylindrical bore in the surface of the plug facing the discharge volume. The feedthrough can be butt-welded to the shaft.

Figure 5A:
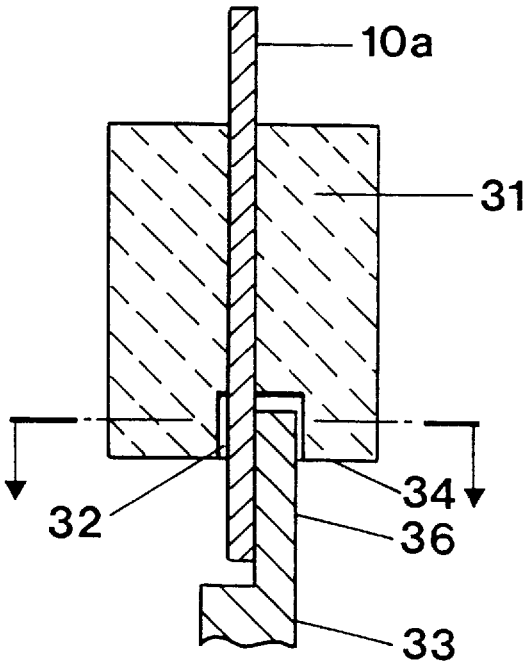
Figure 5B:
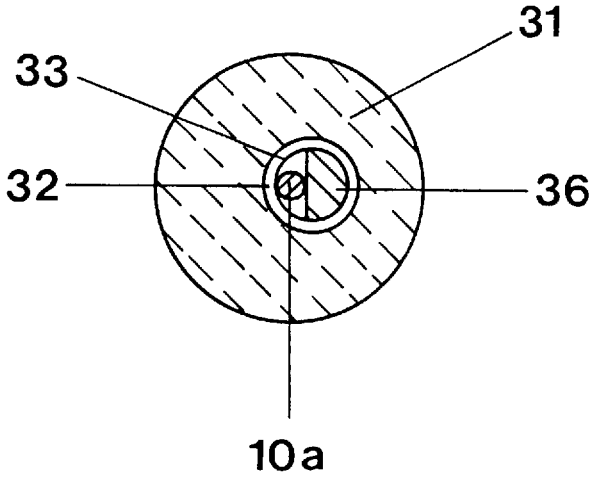

Even better stabilisation is obtained when the shaft 33 has a projection 36 to which the feedthrough 10*a* is welded, as shown in FIG. 5*a*. The bore 32 in the surface of the plug 31 surrounds both the feedthrough 10*a* and the projection 36 of the shaft 33 (see FIG. 5*b*). The term "loosely surrounding" here has the meaning that the distance should be as small as possible—in order to obtain stabilisation but big enough to ensure that during sintering any contact of the metal parts 10*a,* 33 with the wall of the bore 32 is avoided. Preferably, the distance might be about 150 μm. For the same reason, the distance of the shaft 33, which is made from tungsten, to the bottom of the bore 32 should be in the order of about 500 μm.

Figure 6:
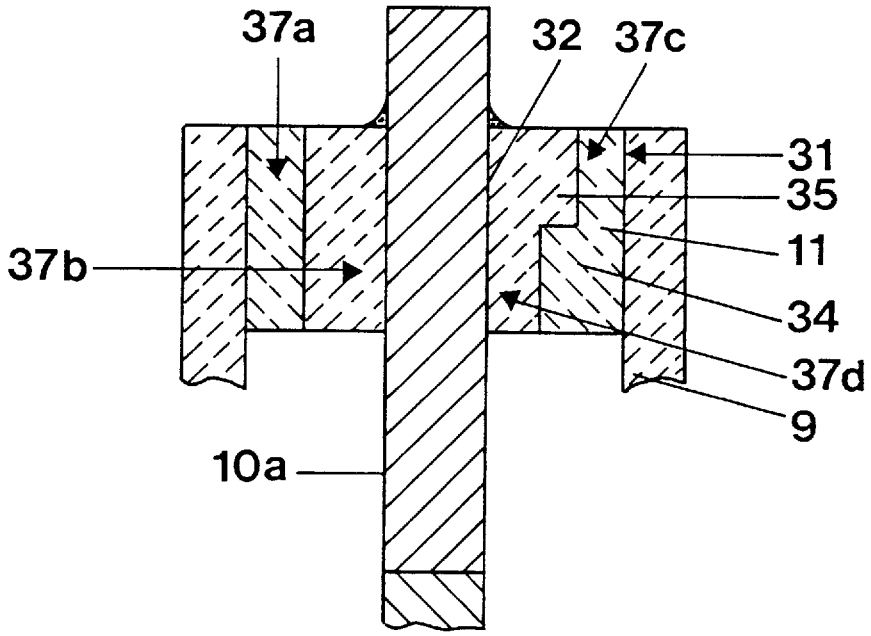

In a further example, shown in FIG. 6, the plug again consists of a composite material. It is divided into two concentric cylindrical parts 37*a* and *b*. Each part has a different proportion of molybdenum (left side of FIG. 6). Whereas the outer part 37*a* comprises 20% by weight of molybdenum, the balance being alumina, the inner part 37*b* comprises 28% by weight of molybdenum, balance alumina. Thus, a more graded transition of the thermal coefficients of expansion is achieved between the pure alumina of the end 9 of the discharge vessel and the pure metal of the molybdenum pin 10*a*.

In a preferred embodiment (right side of FIG. 6) the outer part 37*c* of the plug has a step 34, on which a nose 35 of the inner part 37*d* rests, so that manufacturing is simplified.

Instead of using plugs made of two parts in connection with pin-like or tubular feedthroughs, it is possible to use plugs made of three or even more concentric parts with stepwise graded thermal coefficients of expansion. In this case, the differences in thermal expansion coefficients between adjacent parts are smaller than with a two-part plug. When compared with an arrangement using a tubular feedthrough, it is advantageous to use a plug consisting of two or more parts and a tiny pin-like feedthrough because the bore of the plug can be made smaller.

In a further embodiment the proportion of the molybdenum or of another second component of the composite material varies inside the one or more parts of the plug. The proportion of the molybdenum or other second-component material increases in radial direction from the outer surface to the inner surface, whereby a smoother transition of the thermal expansion coefficients is achieved. On the other hand, the preparation of the plug is more complex.

We claim:

1. Method of making an alumina ceramic discharge vessel for a high-pressure discharge lamp, wherein the alumina ceramic discharge vessel (8) is formed with first and second tubular ends (9), and adapted to contain an ionizable fill including a halogen containing component, characterized by the following steps:

a) providing the discharge vessel in form of a green body, with said first and second ends being open;

b) providing a pin-like metallic feedthrough which has a diameter smaller than 500 μm, and is of the metals of the group consisting of molybdenum, tungsten, rhenium, an alloy of molybdenum, an alloy of tungsten, and an alloy of rhenium connected to an electrode system;

c) providing a green body of a plug which consists of a composite material whose thermal expansion coefficient lies between the thermal expansion coefficients of the vessel ceramic and of the feedthrough metal, said plug being formed with an axial hole therein;

d) positioning the said feedthrough in the axial hole of the said green body to form a subassembly;

e) inserting said subassembly into the first end of the ceramic discharge vessel which is in its green state to form an assembly;

f) final sintering of the assembly of step e);

g) covering of the interface between the pin-like feedthrough and the plug of the subassembly, at the surface facing away from the electrode system, with a sealing material;

h) evacuating and filling the discharge vessel with an ionizable fill which includes a halogen containing component through an opening at or near the second end thereof; and i) gas-tightly closing the opening of the second end.

2. The method of claim 1, characterized by heating said sealing material to form a melt seal between the feedthrough and said surface.

3. The method of making a vessel according to claim 1, characterized in that step (e) comprises, inserting a second ceramic plug in green state and formed with an opening therein into the second end of the vessel.

4. The method of claim 3, characterized in that a second feedthrough is located in said opening of the second plug.

5. The method of claim 4, wherein said second feedthrough is tubular.

6. The method of claim 3, further including the step of j) covering the interface between the second feedthrough and the second plug, at the surface (18) facing away from the electrode system, with a sealing material (7*a*) and forming a melt seal by applying heat to the sealing material.

7. The method of claim 6, wherein said step j) follows the final sintering step i).

8. The method of claim 1, characterized in that step (i) of closing of the second end of the vessel comprises:

i1) inserting a finally sintered plug having a pin-like feedthrough with an electrode system connected thereto into said second open end;

i2) closing at least part of the gap between the outer circumference of the plug and the second end of the vessel with a ceramic sealing material and sealing it by applying heat; and i3) covering the interface between the pin-like feedthrough and the second plug, at the surface facing away from the electrode system, with a sealing material and sealing it by applying heat.

9. The method of claim 8, characterized in that at least the two steps i2) and i3) are carried out simultaneously.

10. The method of claim 1, characterized in that the composite material of the plug comprises alumina as a first component and having molybdenum or tungsten as a second component, and in that the alumina is present in form of a powder and the molybdenum or tungsten are added as a powder of the respective oxide to the alumina powder during the process of preparing the composite material of the green body, optionally in form of a composite dispersion.

11. The method of claim 1, characterized in that said sealing material comprises the following components (in percent by weight):

15–30% $Al_2O_3$

25–35% $SiO_2$

20–35% $Y_2O_3$

10–30% $La_2O_3$

1–20% Mo metal.

12. The method of claim 1, characterized in that said sealing material comprises the following components (in percent by weight):

20–35% $Al_2O_3$

20–30% $SiO_2$

30–40% $Y_2O_3$

1–10% at least one of $MoO_3$ and $WO_3$.

* * * * *